US008757869B2

(12) United States Patent
Kruttli

(10) Patent No.: US 8,757,869 B2
(45) Date of Patent: Jun. 24, 2014

(54) IMPACT-PROOF TIMEPIECE ESCAPEMENT

(75) Inventor: Anthony Kruttli, Orchamps-Vennes (FR)

(73) Assignee: Patek Philippe SA Geneve, Geneva (CH)

( * ) Notice: Subject to any disclaimer, the term of this patent is extended or adjusted under 35 U.S.C. 154(b) by 46 days.

(21) Appl. No.: 13/579,497

(22) PCT Filed: Mar. 31, 2011

(86) PCT No.: PCT/IB2011/000690

§ 371 (c)(1),
(2), (4) Date: Aug. 16, 2012

(87) PCT Pub. No.: WO2011/121432

PCT Pub. Date: Oct. 6, 2011

(65) Prior Publication Data

US 2012/0307601 A1 Dec. 6, 2012

(30) Foreign Application Priority Data

Apr. 1, 2010 (CH) ..... 0487/10

(51) Int. Cl.
*G04B 15/00* (2006.01)

(52) U.S. Cl.
USPC ..... 368/131

(58) Field of Classification Search
CPC ..... G04B 15/08; G04B 15/14; G04B 15/06; G04B 15/12
USPC ..... 368/127–133
See application file for complete search history.

(56) References Cited

U.S. PATENT DOCUMENTS

| | | | | | |
|---|---|---|---|---|---|
| 26,531 | A | * | 12/1859 | Spicer | 368/132 |
| 1,120,694 | A | * | 12/1914 | Davies | 368/132 |
| 3,146,581 | A | | 9/1964 | Garbe | |
| 3,685,279 | A | | 8/1972 | Scholz | |
| 3,805,513 | A | * | 4/1974 | Theurillat | 368/124 |
| 3,826,076 | A | * | 7/1974 | Tuetey | 368/129 |
| 3,834,155 | A | * | 9/1974 | Wuthrich | 368/132 |
| 4,041,693 | A | * | 8/1977 | Bonsack | 368/124 |
| 2008/0101162 | A1 | * | 5/2008 | Born | 368/132 |
| 2009/0168611 | A1 | * | 7/2009 | Gigandet et al. | 368/130 |
| 2010/0208555 | A1 | * | 8/2010 | Hiraoka et al. | 368/131 |

FOREIGN PATENT DOCUMENTS

| | | | |
|---|---|---|---|
| CH | 101651 | A | 10/1923 |
| CH | 343898 | A | 2/1960 |
| CH | 569997 | B5 | 6/1975 |
| CH | 699273 | B1 | 2/2010 |

(Continued)

OTHER PUBLICATIONS

International Search Report dated Sep. 9, 2011, from corresponding PCT application.

*Primary Examiner* — Amy Cohen Johnson
*Assistant Examiner* — Matthew Powell
(74) *Attorney, Agent, or Firm* — Young & Thompson

(57) ABSTRACT

The escapement comprises an escapement wheel (1) and an anchor (2). In the place of the traditional limiting walls or pins, the escapement comprises, on the anchor (2) and/or the escapement wheel (1), means (17, 18) for limiting the oscillations of the anchor (2) during normal operation of the escapement. In order to prevent contact between the impulse beak (10) of the pallets (6, 7) and the escapement wheel (1) upon impacts, the escapement wheel (1) has protrusions (20, 21, 22) at its periphery.

17 Claims, 16 Drawing Sheets

(56) References Cited

FOREIGN PATENT DOCUMENTS

| | | | |
|---|---|---|---|
| DE | 1162290 | B | 1/1964 |
| EP | 1045297 | A1 | 10/2000 |
| EP | 1892589 | A1 | 2/2008 |
| EP | 1914605 | A1 | 4/2008 |
| FR | 2067206 | A1 | 8/1971 |
| GB | 682566 | A | 11/1952 |

* cited by examiner

IMPACT-PROOF TIMEPIECE ESCAPEMENT

BACKGROUND OF THE INVENTION

1. Field of the Invention

The present invention relates to an anchor escapement for a timepiece, such as a Swiss lever escapement.

2. Description of the Related Art

Anchor escapements generally comprise fixed limitation members in the form of walls called "solid bankings" machined in the bottom plate or in a bridge, or in the form of pins fixed to the bottom plate. These fixed limitation members serve as abutments for the anchor in order to limit the amplitude of its oscillations and define two lock positions where the anchor is in abutment against a respective one of these fixed limitation members, while a tooth of the escapement wheel is itself in abutment against the locking plane of the entry or exit pallet of the anchor. These fixed limitation members also act to protect the escapement against impacts in that they prevent the anchor from moving beyond its lock positions when the watch is subjected to impacts and thus prevent the pallets of the anchor from being able to strike the escapement wheel.

However, there are anchor escapements which do not have such fixed limitation members. In this case it is a particular arrangement or shape of the toothing of the escapement wheel and/or of the pallets which fulfils the function of limiting oscillations of the anchor during normal operation of the escapement, i.e. which defines the lock positions of the anchor. Examples of such escapements are described in the documents CH 101651, CH 569997, CH 343898, DE 1162290, GB 682566 and U.S. Pat. No. 3,146,581. With the exception of that described in document CH 569997, these escapements all have the disadvantage that, when the watch is subjected to impacts, the anchor can move beyond its lock positions until the impulse beak of one of the pallets strikes the escapement wheel. By way of illustration, FIG. 1 shows the position of an anchor escapement without fixed limitation members after an impact which has displaced the anchor in the direction indicated by the arrow F1, while the anchor was in its lock position where its entry pallet was blocking the escapement wheel. It can be seen that the impulse beak of the entry pallet is in contact with the rim of the escapement wheel. In a similar manner, upon an impact having the effect of displacing the anchor in the opposite direction (FIG. 2, arrow F2), the impulse beak of the exit pallet comes into contact with the rim of the escapement wheel. Such contacts between an edge (impulse beak) and the escapement wheel can cause considerable damage to the anchor and/or the escapement wheel, in particular if these elements, or one of them, is/are produced from a fragile material such as silicon. Furthermore, the chips which can result therefrom can move into the movement of the watch, cause damage to other components and disrupt operation of the movement.

The escapement in accordance with document CH 569997 has dihedral recesses formed in the rim of the escapement wheel, which recesses are intended to receive and lock the pallets in the lock positions of the anchor. In the event of the watch being subjected to an impact, these recesses prevent the anchor from moving beyond its lock positions. In some embodiments, small clearance gaps are also provided in the escapement wheel to prevent the impulse beak of the pallets from coming into contact with the said wheel in the said lock positions. Nevertheless, this escapement has a major disadvantage in that it requires the pallets to be of the same shape and to have identical drawing angles, which prevents the efficiency of the escapement from being optimised by adapting the shapes and dimensions of the pallets.

SUMMARY OF THE INVENTION

The present invention aims to overcome the above-mentioned disadvantages and, to this end, proposes a timepiece escapement having an escapement wheel and an anchor, the anchor comprising an entry pallet and an exit pallet cooperating with teeth on the escapement wheel, each of the entry and exit pallets having a back side, an impulse beak, an impulse face and a lock face, the anchor and/or the escapement wheel comprising means for limiting the oscillations of the anchor during normal operation of the escapement to a range of displacement defined by an entry lock position where the entry pallet blocks the escapement wheel and by an exit lock position where the exit pallet blocks the escapement wheel, characterised in that the escapement wheel comprises, at its periphery, protrusions arranged so that:

upon an impact having the effect of causing the anchor to leave the said range of displacement in a first direction, the impulse face and the back side of the entry pallet can come into abutment on two of the protrusions respectively and thus stop the anchor, without contact between the impulse beak of the entry pallet and the escapement wheel, and/or so that upon an impact having the effect of causing the anchor to leave the said range of displacement in a second direction, the impulse face and the back side of the exit pallet can come into abutment on two of the protrusions respectively and thus stop the anchor, without contact between the impulse beak of the exit pallet and the escapement wheel.

The protrusions can comprise first protrusions located between the teeth of the escapement wheel and each being able to serve as an abutment for the impulse face of the entry pallet in the event of an impact having the effect of causing the anchor to leave the said range of displacement in the first direction, and to serve as an abutment for the back side of the exit pallet in the event of an impact having the effect of causing the anchor to leave the said range of displacement in the second direction.

The protrusions can also comprise second protrusions located on the rear flanks of the teeth of the escapement wheel or between the said teeth and each being able to serve as an abutment for the back side of the entry pallet in the event of an impact having the effect of causing the anchor to leave the said range of displacement in the first direction.

The protrusions can also comprise third protrusions located on the front flanks of the teeth of the escapement wheel or between the said teeth and each being able to serve as an abutment for the impulse face of the exit pallet when the impact has the effect of causing the anchor to leave the said range of displacement in the second direction.

The protrusions are preferably rounded.

The said means for limiting the oscillations of the anchor can comprise a corner defined by the lock face of the entry pallet and/or of the exit pallet and with which a lock beak of the teeth of the escapement wheel can cooperate.

The corner is preferably defined by a return plane and by a lock plane which are formed on the lock face of the entry pallet and/or exit pallet, and the protrusions are arranged so that:

after an impact having the effect of causing the anchor to leave the said range of displacement in the first direction as far as the said stopping of the anchor, one of the said two protrusions can push the anchor towards its entry lock position until cooperation between the lock beak of a tooth of the escapement wheel and the return plane of the entry pallet finishes returning the anchor to its entry lock position under the action of the rotation of the escapement wheel;

and/or so that:

after an impact having the effect of causing the anchor to leave the said range of displacement in the second direction as far as the said stopping of the anchor, one of the said two protrusions can push the anchor towards its exit lock position until cooperation between the lock beak of a tooth of the escapement wheel and the return plane of the exit pallet finishes returning the anchor to its exit lock position under the action of the rotation of the escapement wheel.

The anchor and the escapement wheel can each be produced as a single piece.

In particular embodiments, at least one of the anchor and the escapement wheel is produced from a fragile material such as glass, diamond, silicon, silicon carbide, crystallised aluminium oxide or another material based on one of these materials.

In one embodiment, the anchor comprises a fork having a fork notch and horns, and the inner face of each horn is rounded so as to soften the transition between this inner face and the corresponding inner face of the fork notch.

In another embodiment, the escapement comprises a member for transmission between the anchor and a balance staff, this member comprises a part acting as an impulse pin, the said part comprises convex active surfaces and an inactive surface connecting the active surfaces to each other, and the inactive surface is convex with a radius of curvature which is greater than that of the active surfaces so as to soften the transition between the inactive surface and each of the active surfaces. The said member is preferably a single-piece member comprising an opening for its mounting on the balance staff and a protrusion extending radially and constituting the said part acting as an impulse pin.

The escapement in accordance with the invention is typically a Swiss lever escapement.

The present invention also proposes an escapement anchor for a timepiece comprising a fork having a fork notch and horns, characterised in that the inner face of each horn is rounded so as to soften the transition between this inner face and the corresponding inner face of the fork notch.

The present invention further proposes a member for transmission between a timepiece anchor and a timepiece balance staff, comprising a part acting as an impulse pin, the said part comprising convex active surfaces and an inactive surface connecting the active surfaces to each other, characterised in that the inactive surface is convex with a radius of curvature which is greater than that of the active surfaces so as to soften the transition between the inactive surface and each of the active surfaces.

The invention also relates to a timepiece, such as a wrist watch, comprising an escapement, an anchor or a transmission member as defined above.

BRIEF DESCRIPTION OF THE DRAWING FIGURES

Other features and advantages of the present invention will become apparent from reading the following detailed description given with reference to the attached drawings in which:

FIG. 1, already discussed, shows a plan view of an escapement of a known type receiving an impact having the effect of causing the anchor to leave its normal range of displacement in a first direction;

FIG. 2, already discussed, shows the same escapement receiving an impact having the effect of causing the anchor to leave its normal range of displacement in a second direction opposite to the first direction;

DETAILED DESCRIPTION OF THE INVENTION

Figure 1:
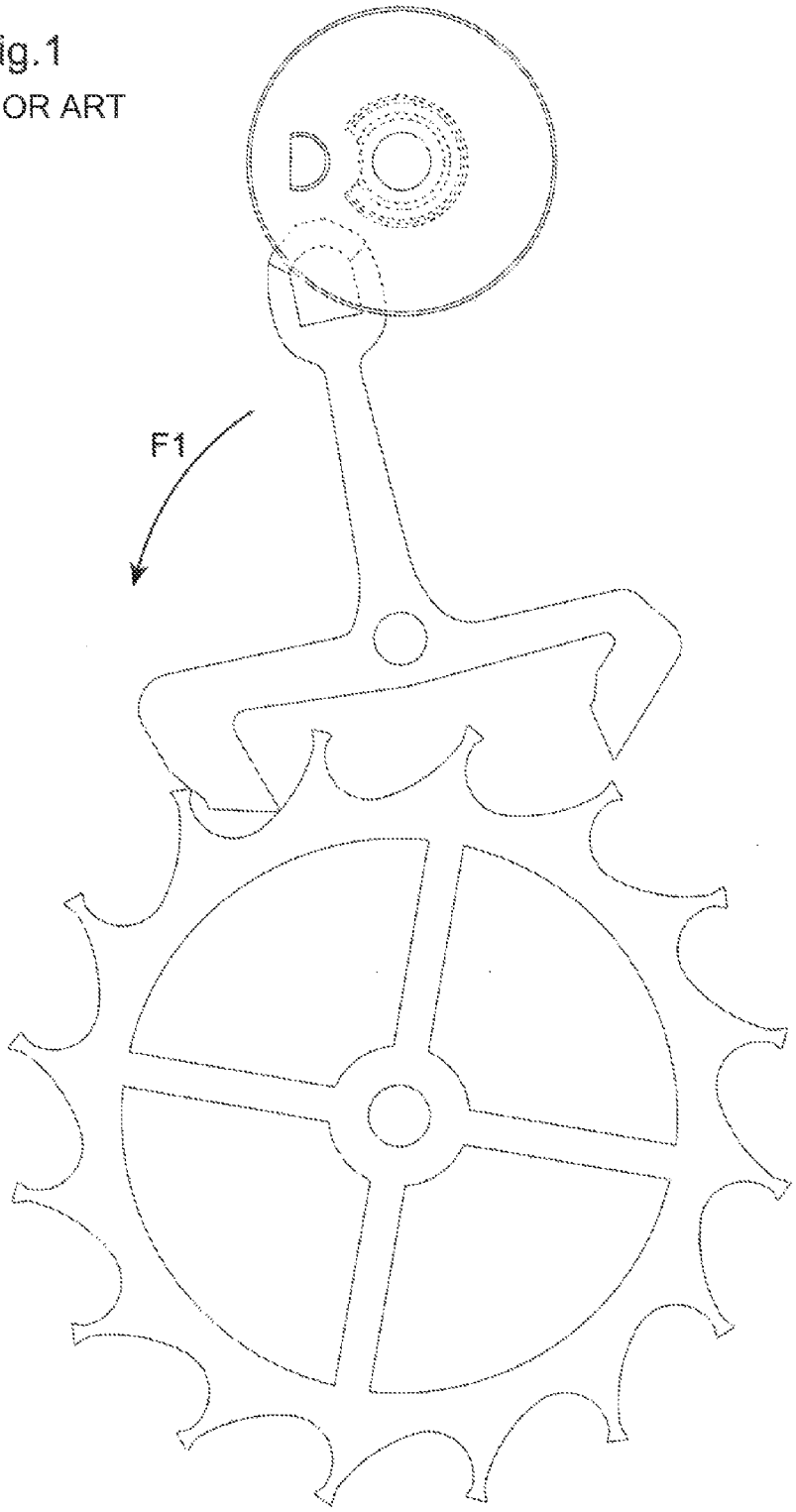
Fig.1 PRIOR ART
Figure 2:
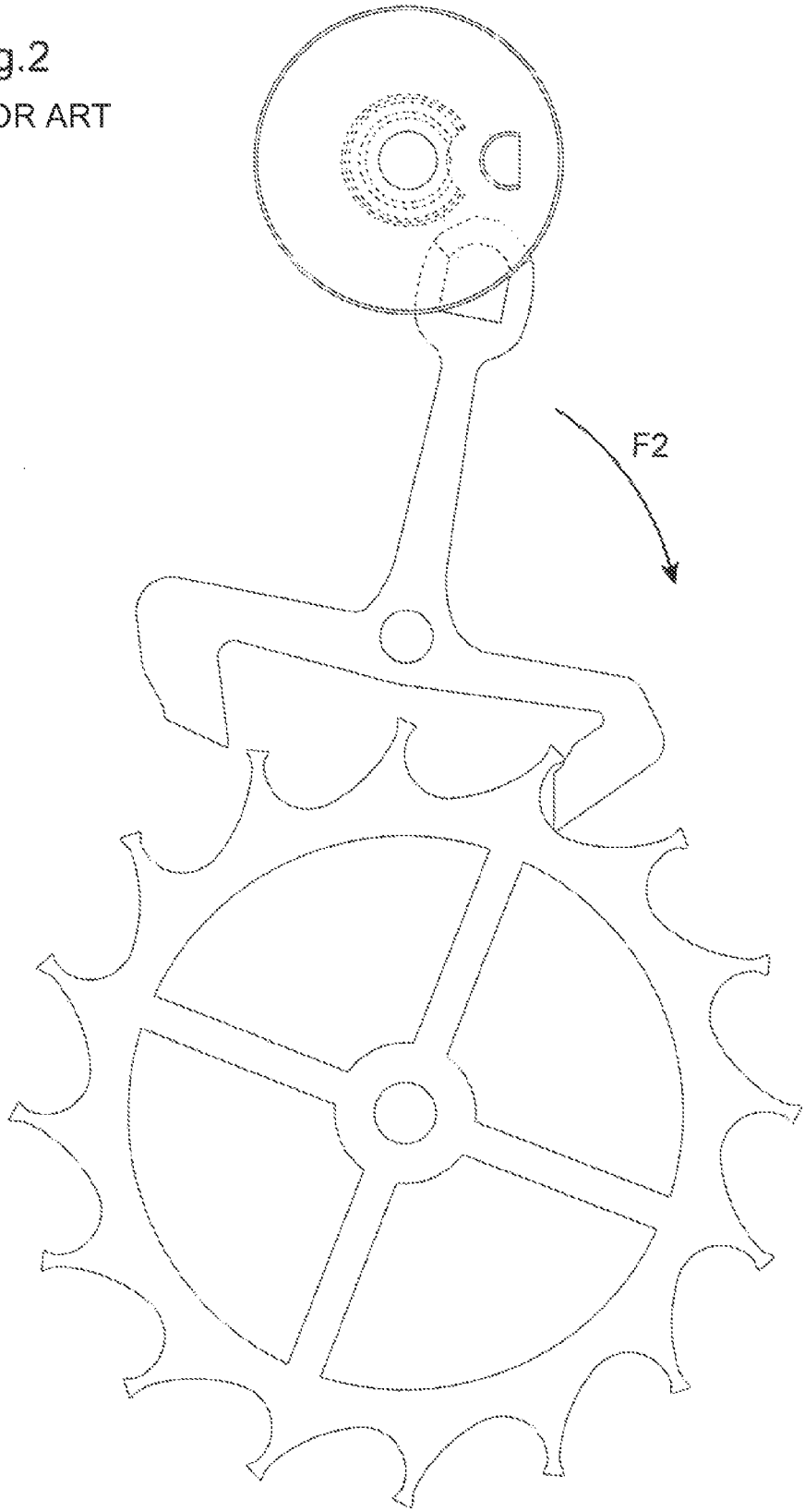
Fig.2 PRIOR ART
Figure 3:
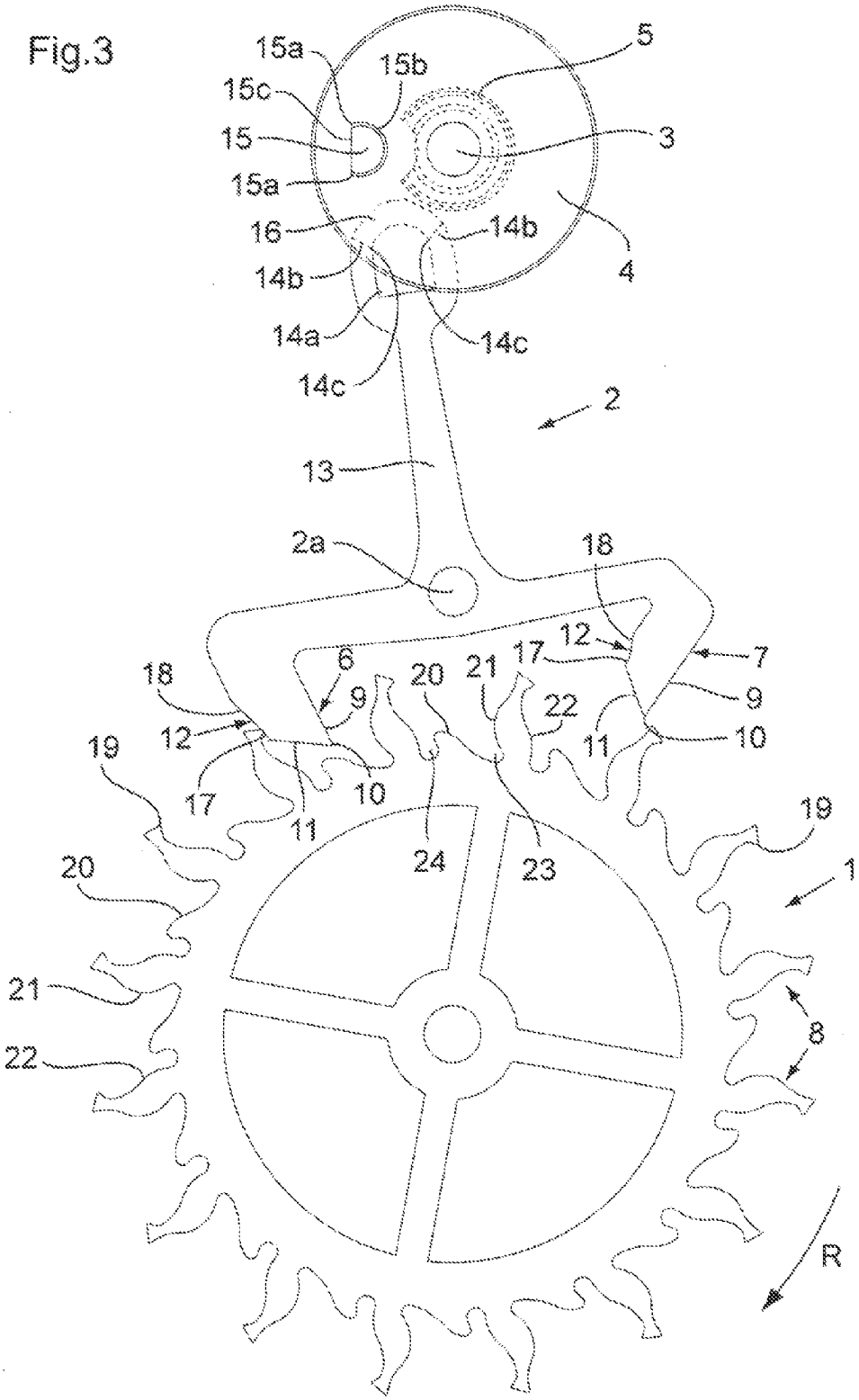
FIGS. 3 and 4 show an escapement in accordance with a first embodiment of the invention with its anchor located respectively in its entry lock position where the entry pallet of the anchor blocks the escapement wheel, and in its exit lock position where it is the exit pallet of the anchor which blocks the escapement wheel.

In reference to FIG. 3, an escapement in accordance with a first embodiment of the invention for a timepiece such as a wrist watch comprises an escapement wheel 1, an anchor 2 and, mounted on a balance staff 3, a member for transmission between the anchor 2 and the balance staff 3 constituted e.g. by a roller table 4 and a safety roller 5. As in a traditional Swiss lever escapement, the anchor 2 is mounted pivoting on a staff 2*a* and comprises an entry pallet 6 and an exit pallet 7 cooperating with the teeth 8 of the escapement wheel 1, each of these pallets 6, 7 comprising a back side 9, an impulse beak 10, an impulse face 11 and a lock face 12. At the end of its arm 13, the anchor 2 comprises a fork comprising a fork notch 14*a* cooperating with an impulse pin or "ellipse" 15 fixedly attached to the roller table 4, horns 14*b* and a member 16 acting as a guard pin and cooperating with the safety roller 5. The operation of the escapement is thus identical to that of a traditional Swiss lever escapement.

Figure 4:
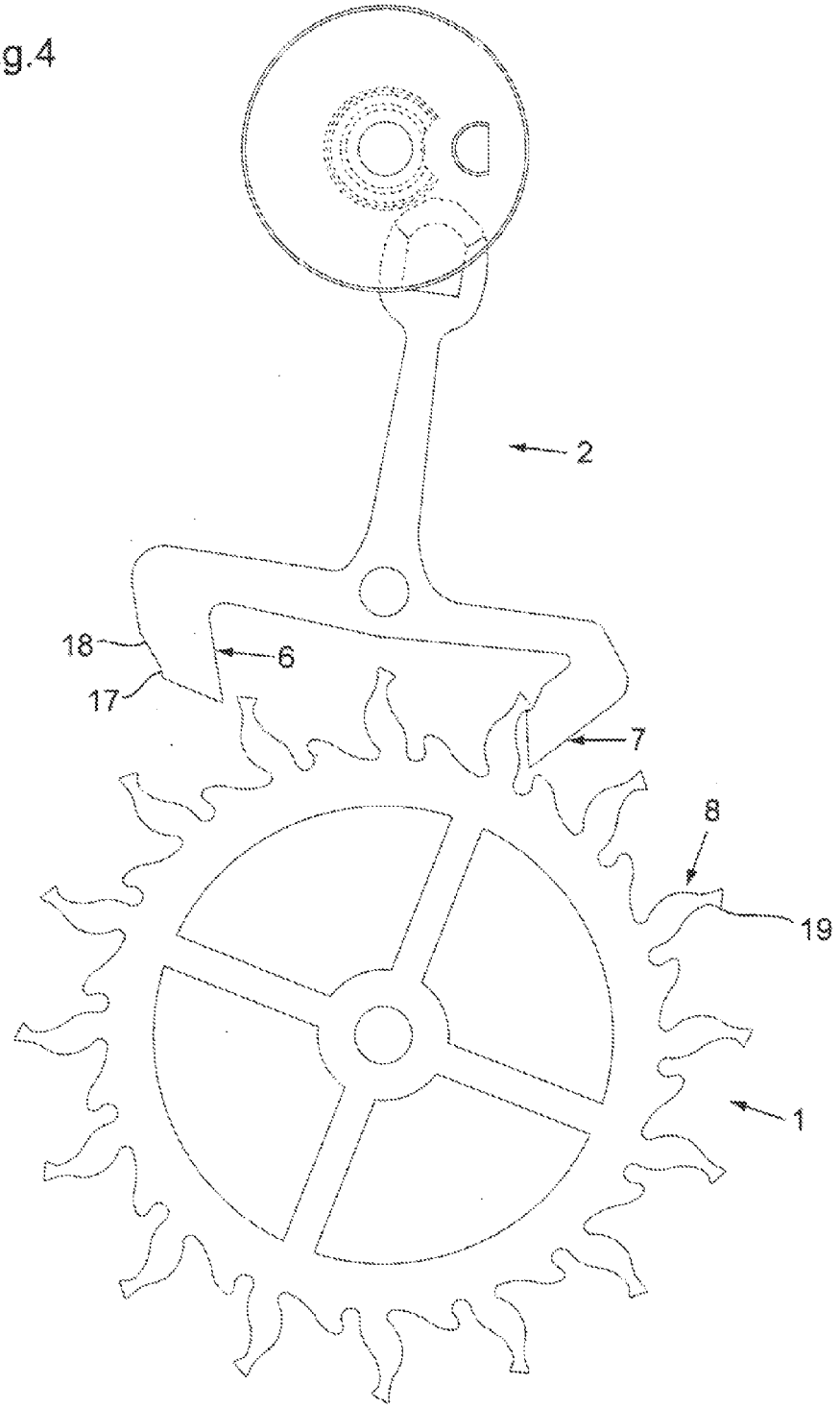

The function of limiting the oscillations of the anchor 2 in normal operation of the escapement is not ensured by fixed solid bankings or pins but by a particular shape of the entry and exit pallets 6, 7 of the anchor 2. Thus these pallets 6, 7 comprise, on their lock face 12, a lock plane 17 and a return plane 18 forming an angle between them. The stopping of the anchor 2 in its entry lock position where its entry pallet 6 blocks the escapement wheel 1 is effected when the lock beak 19 of a tooth 8 of the escapement wheel 1 comes to be housed in the corner defined by the lock plane 17 and the return plane 18 of the entry pallet 6 (FIG. 3). The stopping of the anchor 2 in its exit lock position where its exit pallet 7 blocks the escapement wheel 1 is effected when the lock beak 19 of a tooth 8 of the escapement wheel 1 comes to be housed in the corner defined by the lock plane 17 and the return plane 18 of the exit pallet 7 (FIG. 4).

According to the invention, the escapement wheel 1 has, at its periphery, formations for protecting against impacts, i.e. in this first embodiment:

- first protrusions 20 regularly distributed angularly and formed on the rim of the wheel 1 between the teeth 8;
- second protrusions 21 regularly distributed angularly and formed on the rear flank of the teeth 8;
- third protrusions 22 regularly distributed angularly and formed on the front flank of the teeth 8.

The notions of "front" and "rear" must be understood within the framework of the present invention with respect to the direction of rotation, designated by R, of the wheel 1 when this is being moved by the action of the motor organ (barrel) of the timepiece. The second and third protrusions 21, 22 provide the rear and front flanks of the teeth 8 with a convex shape. The first protrusions 20 are in the form of waves advancing in the inverse direction to the direction R. The protrusions 20, 21, 22 are all rounded. A first clearance gap 23 is provided between each first protrusion 20 and the second protrusion 21 which is consecutive thereto in the direction R. A second clearance gap 24 is provided between each first protrusion 20 and the third protrusion 22 which is consecutive thereto in the direction opposite to the direction R.

Figure 5:
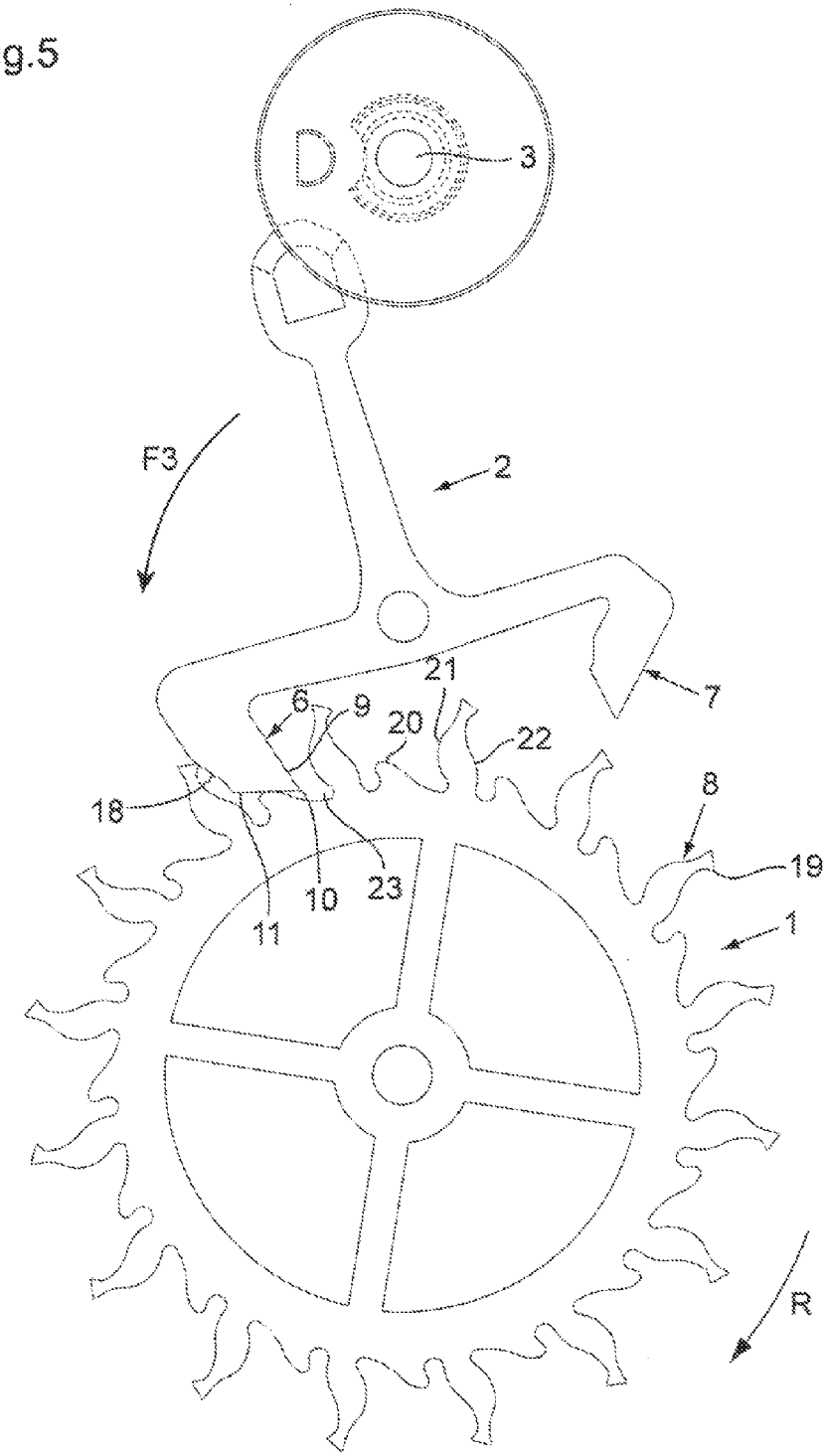
FIG. 5 shows an intermediate position of the escapement in accordance with the first embodiment of the invention upon an impact having the effect of causing the anchor to leave its normal range of displacement in a first direction.
Figure 6:
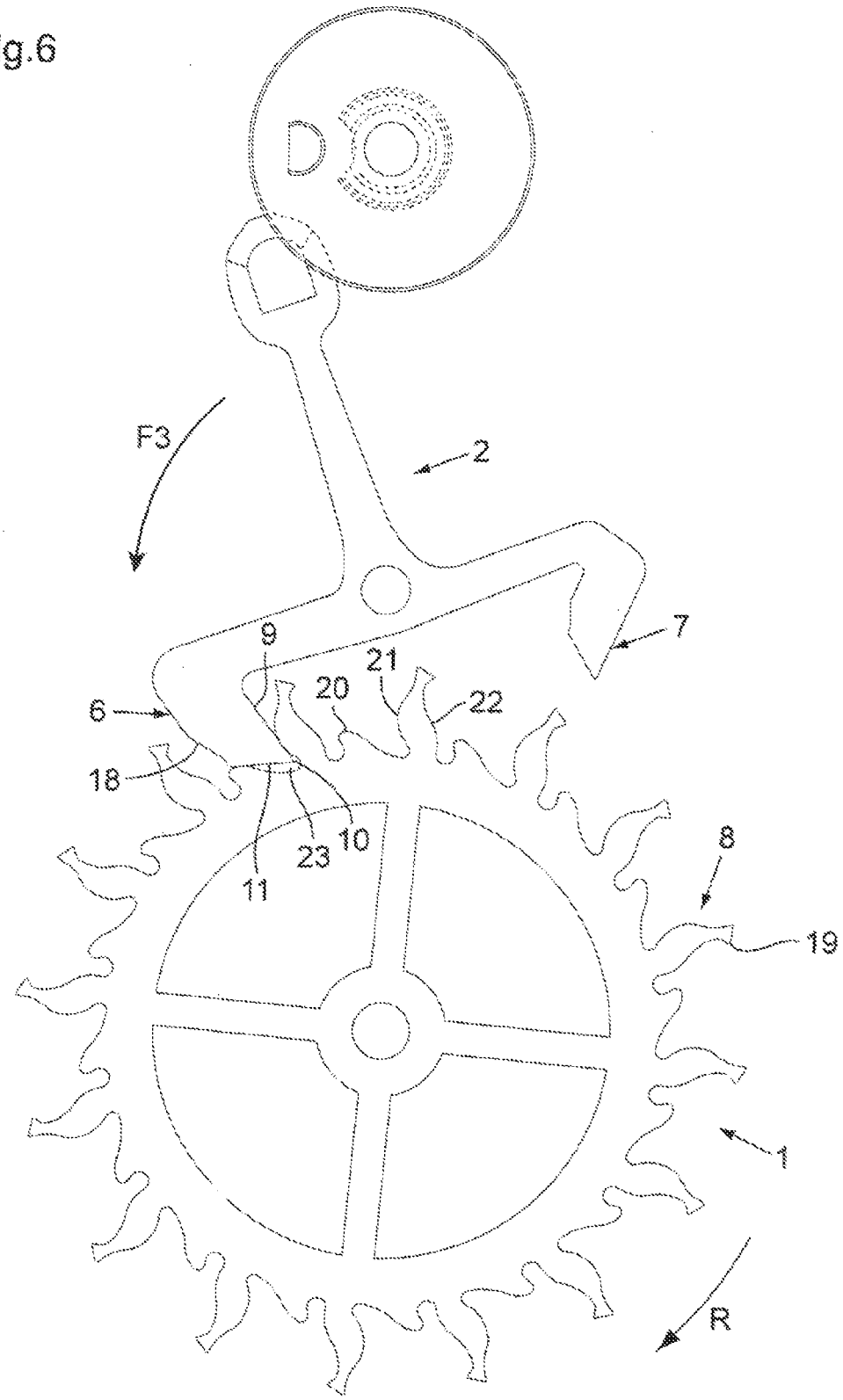
FIG. 6 shows the final position of the escapement in accordance with the first embodiment of the invention upon an impact such as that defined in relation to FIG. 5.

As shown in FIGS. 5 and 6, upon an impact taking place while the anchor 2 was in its entry lock position and having the effect of angularly displacing the anchor 2 in the direction indicated by the arrow F3, i.e. of causing the anchor 2 to leave its normal range of displacement defined by its entry and exit lock positions, the entry pallet 6 is directed towards the rim of the wheel 1, which causes the wheel 1 to move back by reason of the cooperation between the lock beak 19 of one tooth 8 and the return plane 18 of the entry pallet 6, and the impulse face 11 of the entry pallet 6 comes into contact with a protrusion 20 (FIG. 5). The shape of the protrusion 20 permits this movement to continue, the impulse face 11 sliding on the protrusion 20 thus still causing the wheel 1 to move back until the back side 9 of the entry pallet 6 comes into abutment against a protrusion 21 (FIG. 6). At this moment the impulse face 11 applies to the protrusion 20 a force tending to cause the wheel 1 to turn in the direction opposite to the direction R, while the back side 9 applies to the protrusion 21 a force tending to cause the wheel 1 to turn in the direction R. The wheel 1 and the anchor 2 are thus stopped. Throughout the movement caused by the impact, the impulse beak 10 of the entry pallet 6 remains out of contact with the wheel 1. In the final stop position illustrated in FIG. 6, the impulse beak 10 of the entry pallet 6 is located in the clearance gap 23. Once the effect of the impact is over, the anchor 2 is returned to its entry lock position by the protrusion 20 pushing and sliding on the impulse plane 11 then by the lock beak 19 of a tooth 8 pushing and sliding on the return plane 18 under the action of the motor organ driving the escapement wheel 1 in the direction R.

Figure 7:
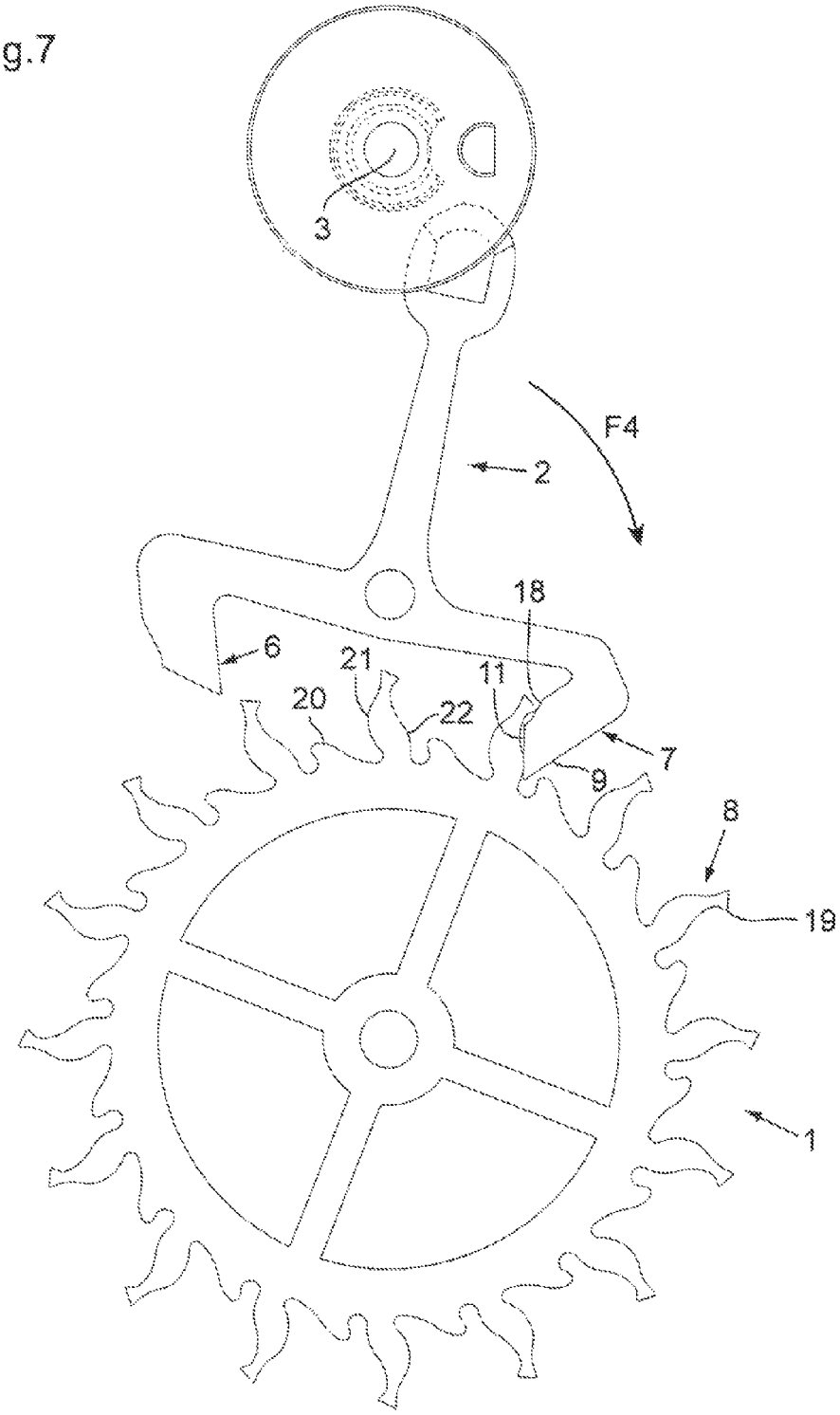
FIG. 7 shows an intermediate position of the escapement in accordance with the first embodiment of the invention upon an impact having the effect of causing the anchor to leave its normal range of displacement in a second direction opposite to the first direction.
Figure 8:
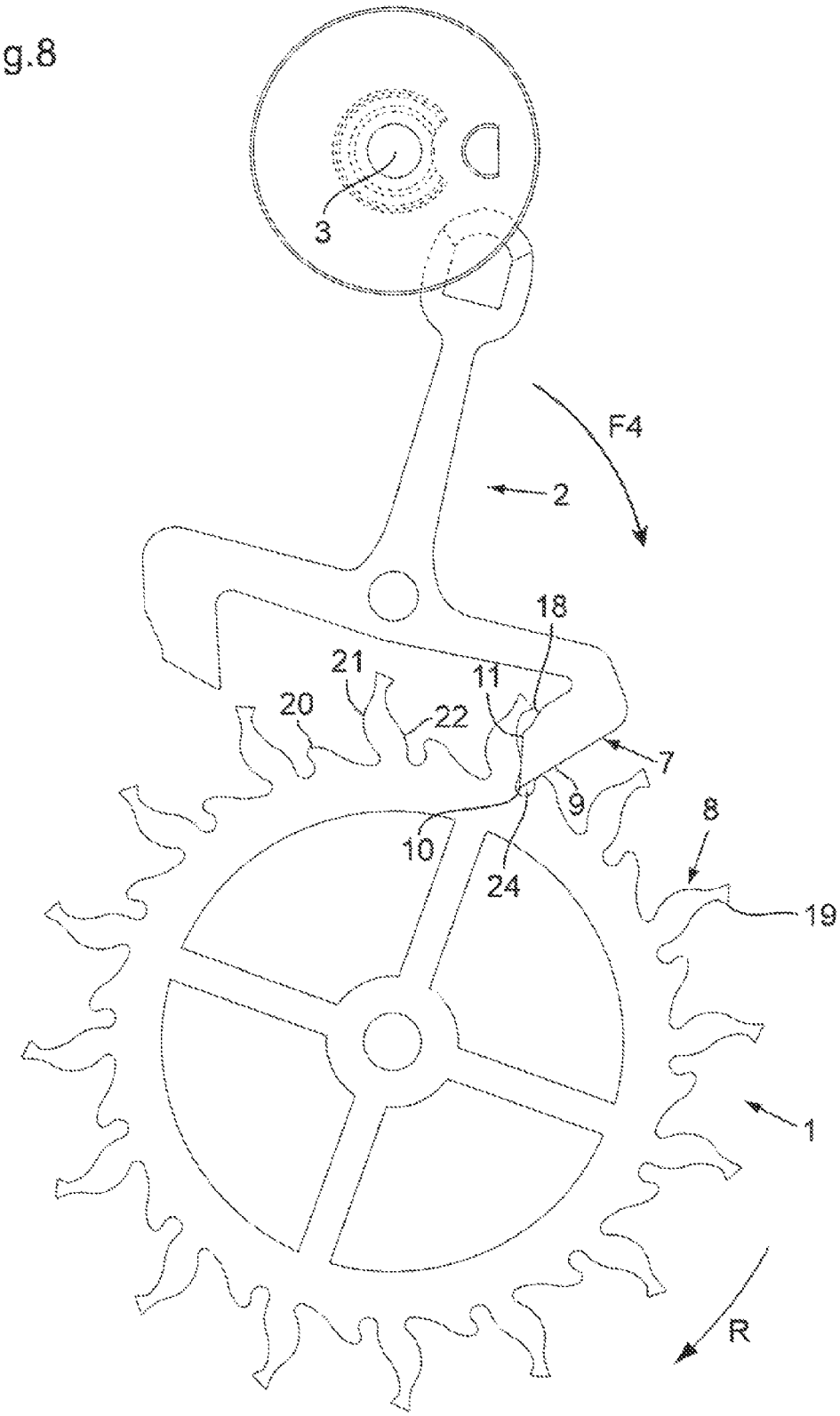
FIG. 8 shows the final position of the escapement in accordance with the first embodiment of the invention upon an impact such as defined in relation to FIG. 7.
Figure 9:
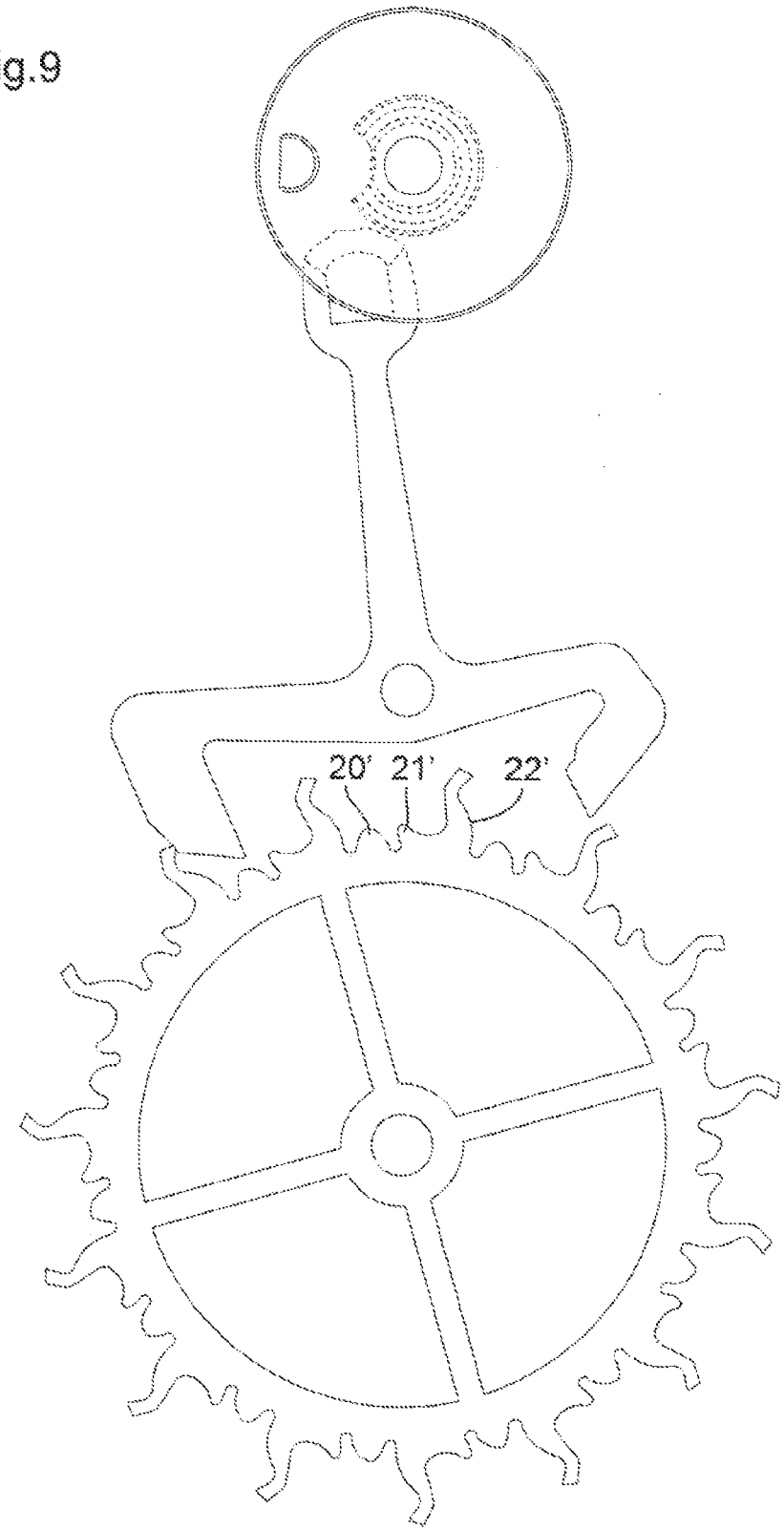
FIGS. 9 and 10 show an escapement in accordance with a second embodiment of the invention with its anchor located respectively in its entry lock position where the entry pallet of the anchor blocks the escapement wheel, and in its exit lock position where it is the exit pallet of the anchor which blocks the escapement wheel.
Figure 10:
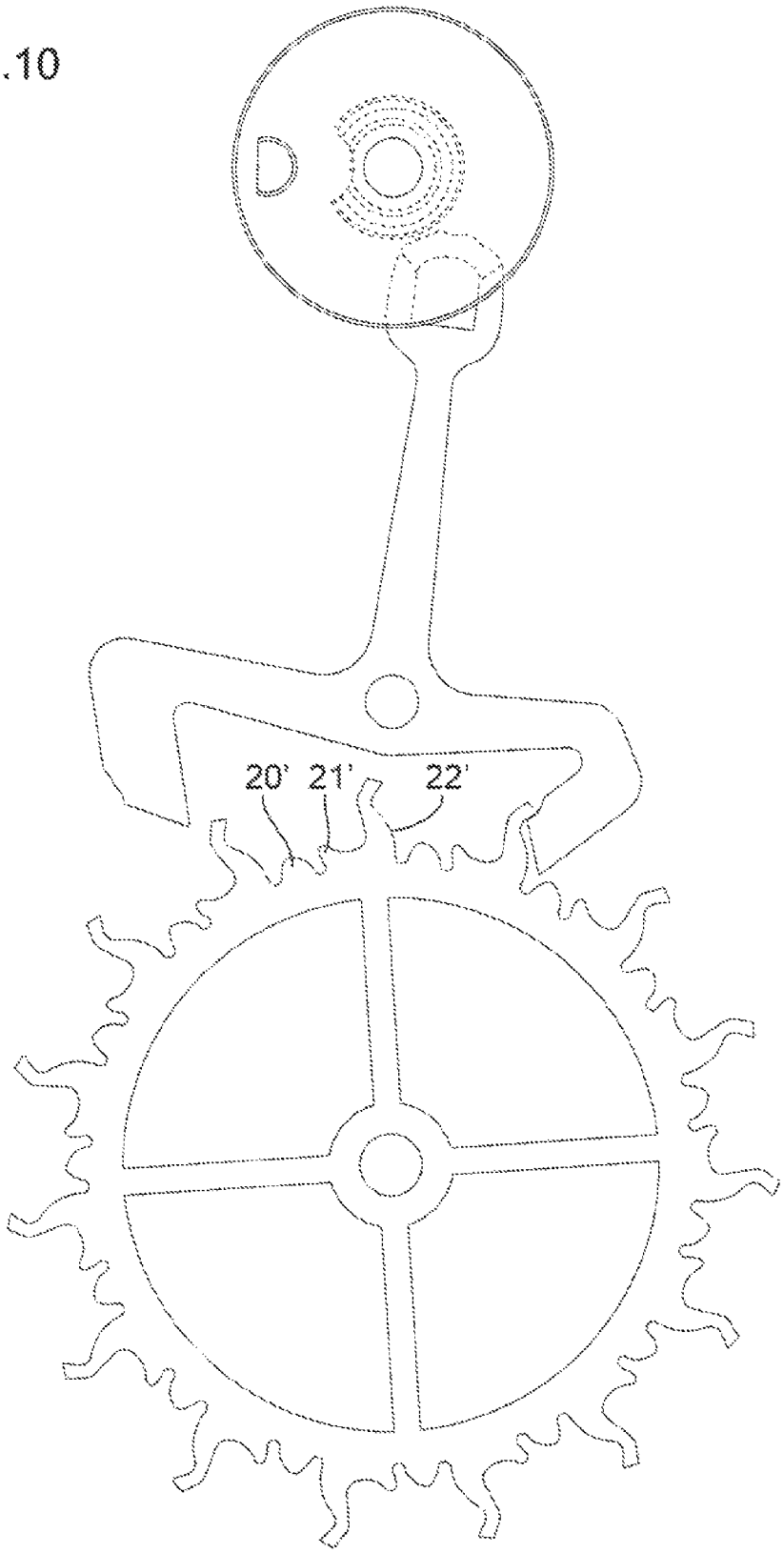
Figure 11:
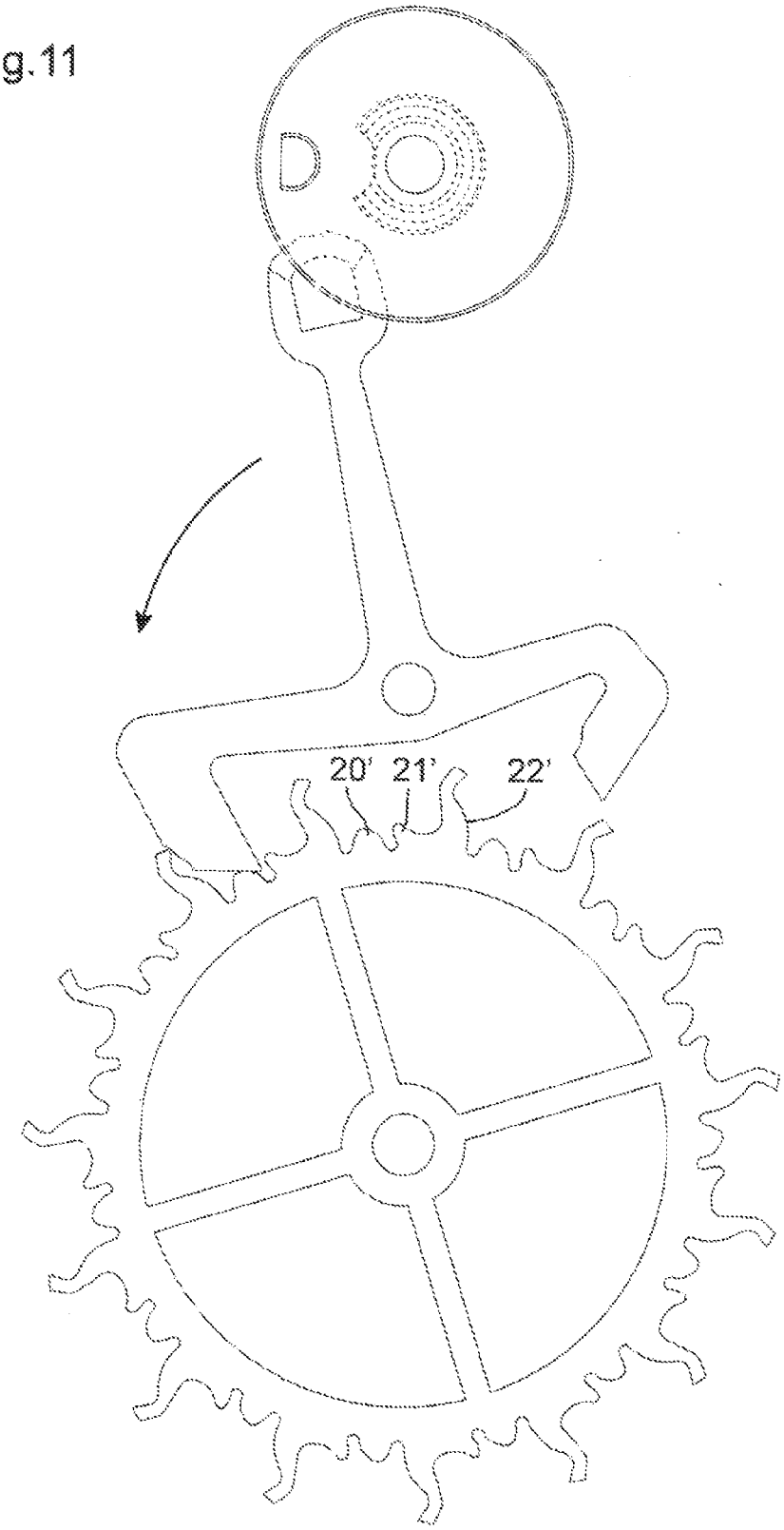
FIG. 11 shows an intermediate position of the escapement in accordance with the second embodiment of the invention upon an impact having the effect of causing the anchor to leave its normal range of displacement in a first direction.
Figure 12:
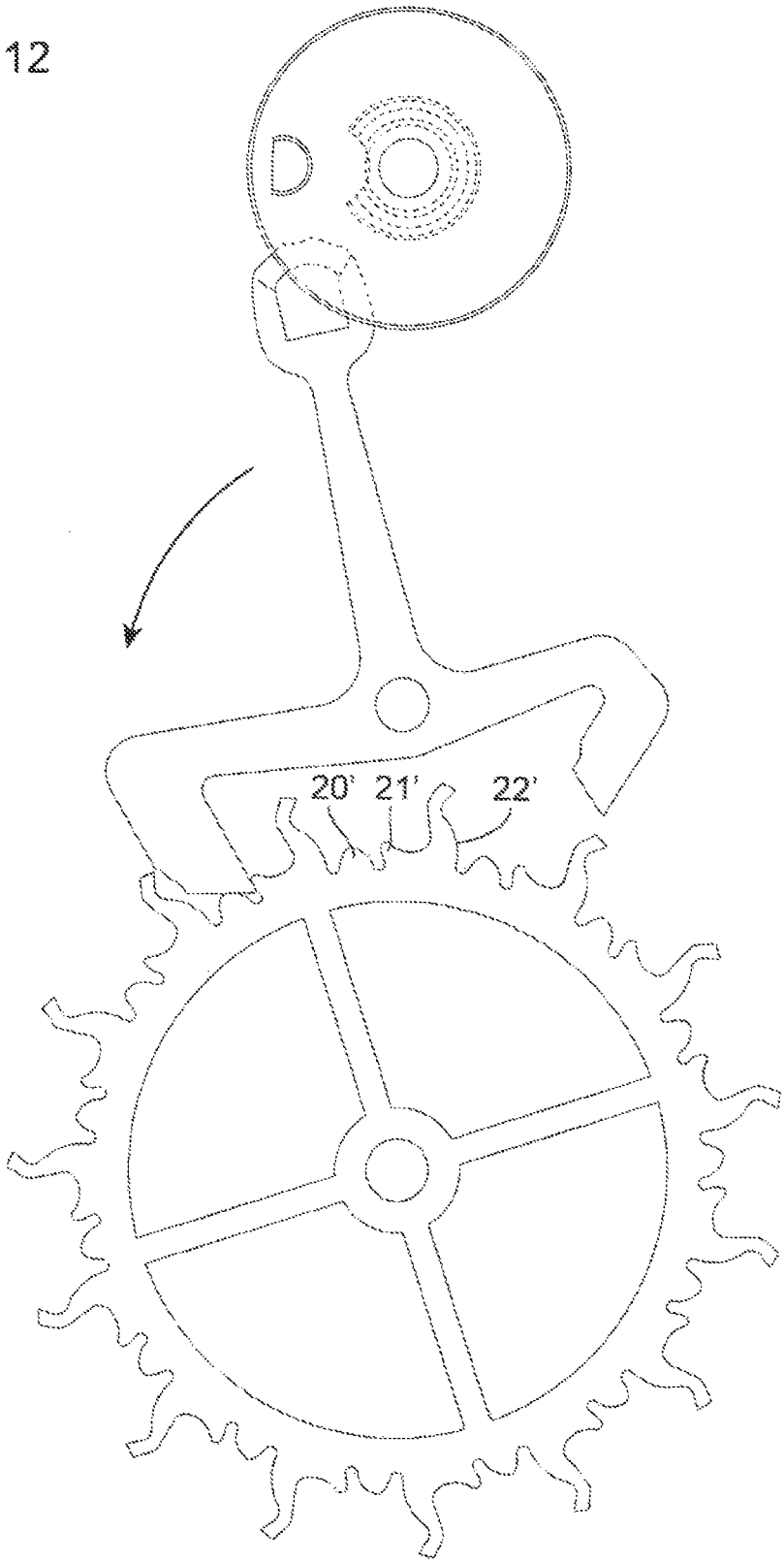
FIG. 12 shows the final position of the escapement in accordance with the second embodiment of the invention upon an impact such as defined in relation to FIG. 11.
Figure 13:
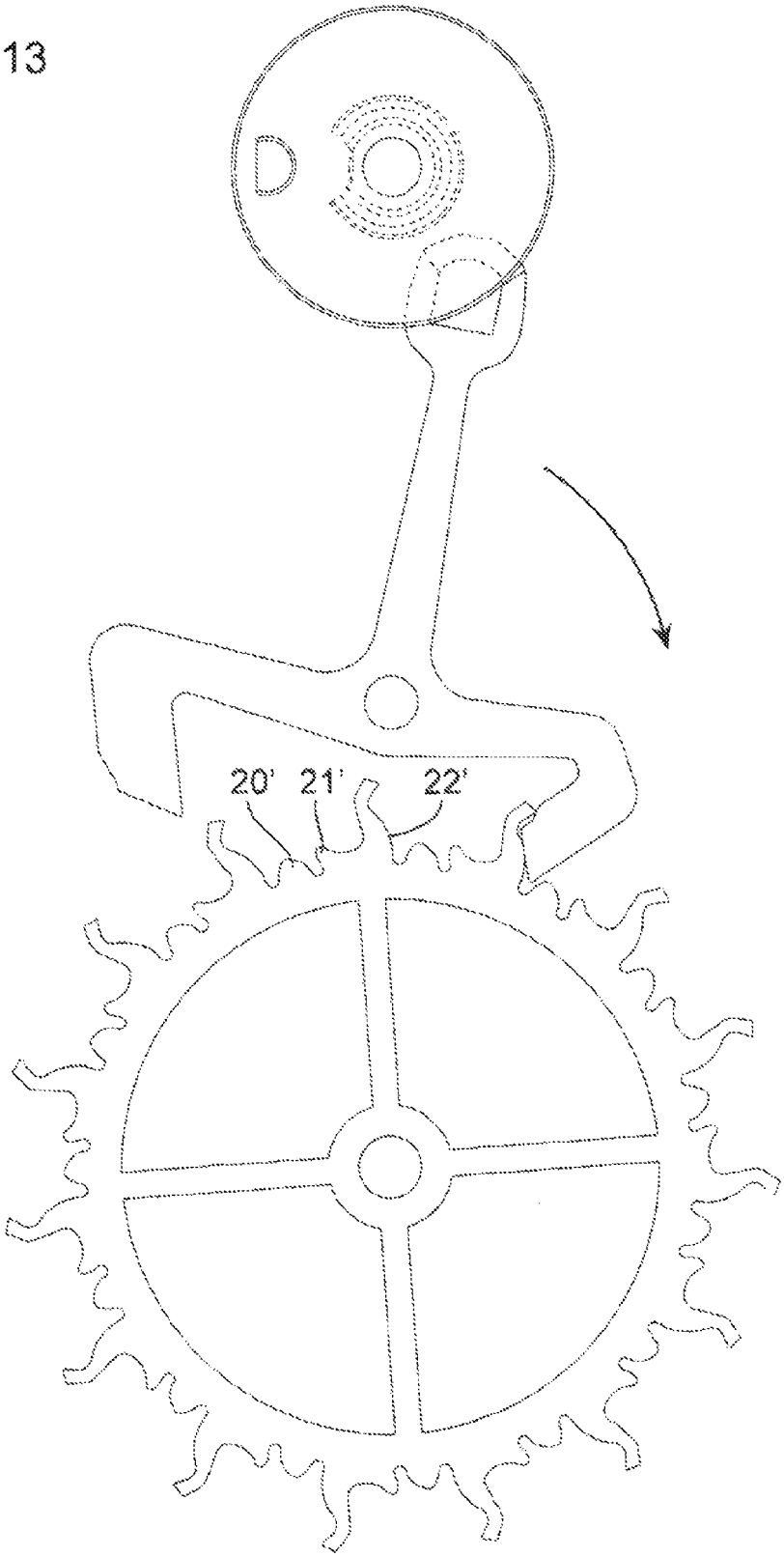
FIG. 13 shows an intermediate position of the escapement in accordance with the second embodiment of the invention upon an impact having the effect of causing the anchor to leave its normal range of displacement in a second direction opposite to the first direction.
Figure 14:
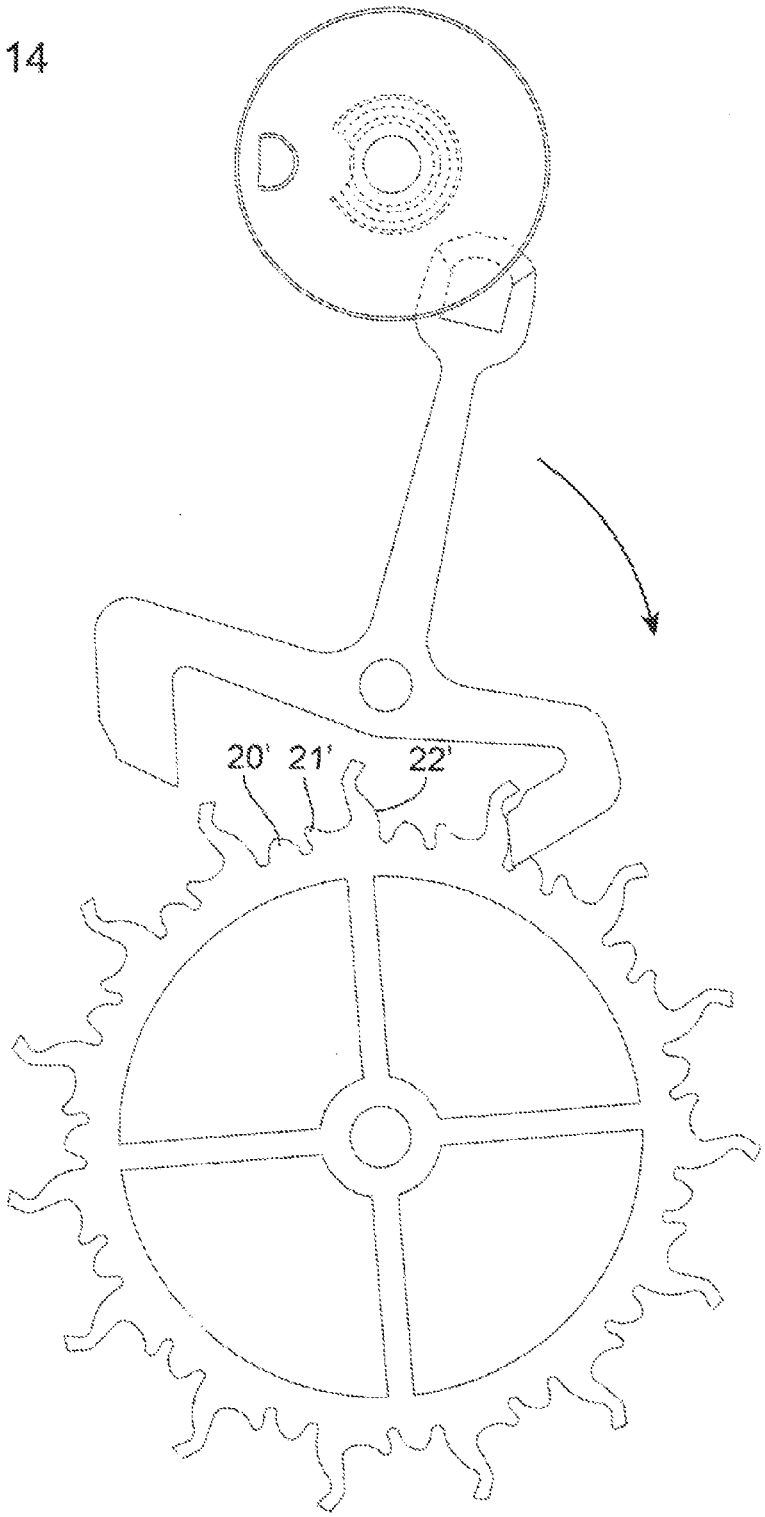
FIG. 14 shows the final position of the escapement in accordance with the second embodiment of the invention upon an impact such as defined in relation to FIG. 13.

As shown in FIGS. 7 and 8, upon an impact taking place while the anchor 2 was in its exit lock position and having the effect of angularly displacing the anchor 2 in the direction indicated by the arrow F4, i.e. causing the anchor 2 to leave its normal range of displacement defined by its entry and exit lock positions, the exit pallet 7 is directed towards the rim of the wheel 1, which causes the wheel 1 to move back by the cooperation between the lock beak 19 of a tooth 8 and the return plane 18 of the exit pallet 7, and the impulse face 11 of the exit pallet 7 comes into contact with a protrusion 22 (FIG. 7). The shape of the protrusion 22 permits this movement to continue, the impulse face 11 sliding on the protrusion 22 thus still causing the wheel 1 to move back until the back side 9 of the exit pallet 7 abuts against a protrusion 20 (FIG. 8). At this moment the impulse face 11 applies to the protrusion 22 a force tending to cause the wheel 1 to turn in the direction opposite to the direction R, while the back side 9 applies to the protrusion 20 a force tending to cause the wheel 1 to turn in the direction R. The wheel 1 and the anchor 2 are thus stopped. Throughout the movement caused by the impact, the impulse beak 10 of the exit pallet 7 remains out of contact with the wheel 1. In the final stop position illustrated in FIG. 8, the impulse beak 10 of the exit pallet 7 is located in the clearance gap 24. Once the effect of the impact is over, the anchor 2 is returned to its exit lock position by the protrusion 22 pushing and sliding on the impulse plane 11 then by the lock beak 19 of a tooth 8 pushing and sliding on the return plane 18 under the action of the motor organ driving the escapement wheel 1 in the direction R.

In this way, while such impacts are occurring, the escapement is protected from any contact between the impulse beak 10 of the pallets 6, 7 and the wheel 1. This result is achieved without it being necessary to impose an arrangement, shape or particular dimensions on the pallets 6, 7, the protrusions 20, 21, 22 not being involved in normal operation of the escapement. Thus, during the design of the escapement, the pallets 6, 7 can be shaped and dimensioned in order to optimise the efficiency of the escapement, e.g. as described in patent application EP 1892589 by this applicant, and then the protrusions 20, 21, 22 can be designed according to the shape and dimensions of the pallets 6, 7.

When the impacts described above take place while the anchor 2 is in movement between its two lock positions, with the impulse pin 15 in the fork notch 14*a* or between the horns 14*b*, the impact will first have the effect of displacing the anchor 2 as far as one of its lock positions and then, if the force of the impact is greater than the force holding the anchor 2 in this lock position, moving the anchor 2 beyond this lock position. The protrusions 20, 21, 22 thus carry out the role described above.

When an impact takes place having the effect of causing the anchor 2 to move towards one of its lock positions, while the anchor 2 was in its other lock position, i.e. of causing the anchor 2 to move in the direction F4 while it was in its entry lock position or in the direction F3 while it was in its exit lock position, the member 16 acting as the guard pin abuts against the safety roller 5, which limits the movement of the anchor 2.

The present invention is of particular interest in the case of escapements produced from a fragile material, i.e. a material with no plastic range such as glass, diamond, silicon, silicon carbide, crystallised aluminium oxide or other materials based on one of these materials. By avoiding any contact between the impulse beak 10 of the pallets 6, 7 and the escapement wheel 1 during an impact, severe stresses inherent in the contacts between edges and surfaces are avoided, which stresses are incompatible with the fragility of such a material. In this respect it will also be noted that the rounded shape of the protrusions 20, 21, 22 contributes to reducing the stresses created by the contacts between the pallets 6, 7 and the escapement wheel 1.

Thus the escapement wheel 1 and the anchor 2, or one of these, can be produced in such a fragile material, in a monolithic manner, e.g. by deep reactive ion etching DRIE.

A second embodiment of the invention is illustrated in FIGS. 9 to 14. The escapement in accordance with this second embodiment is identical to that in accordance with the first embodiment except for the shape of the protrusions 20', 21', 22' of the escapement wheel and for the placement of the second protrusions 21' which are located at least partly on the rim of the said wheel and no longer entirely on the rear flank of the teeth of the said wheel. In one variation, the third protrusions 22' located on the front flank of the teeth of the escapement wheel could be separated from the said teeth and could also be on the rim of the said wheel.

Although it is preferable for the means for limiting oscillations of the anchor in normal operation of the escapement to be provided on the anchor and/or on the escapement wheel both for entry and exit, the present invention does not exclude the use of a fixed limitation member, e.g. of the pin type, for the entry or exit and of limitation means provided on the anchor and/or the escapement wheel for the exit or entry respectively. In this case the protrusions of the escapement wheel would, of course, be useful only on the side, entry or exit, where the said limitation means were located.

Furthermore, the present invention can be applied to escapements of which the escapement wheel is formed not by a plate as shown but by two superimposed plates respectively cooperating with the entry and exit pallets as described in patent application EP 1914605. In this case each of the two plates can have protrusions for the pallet with which it cooperates.

Figure 15:
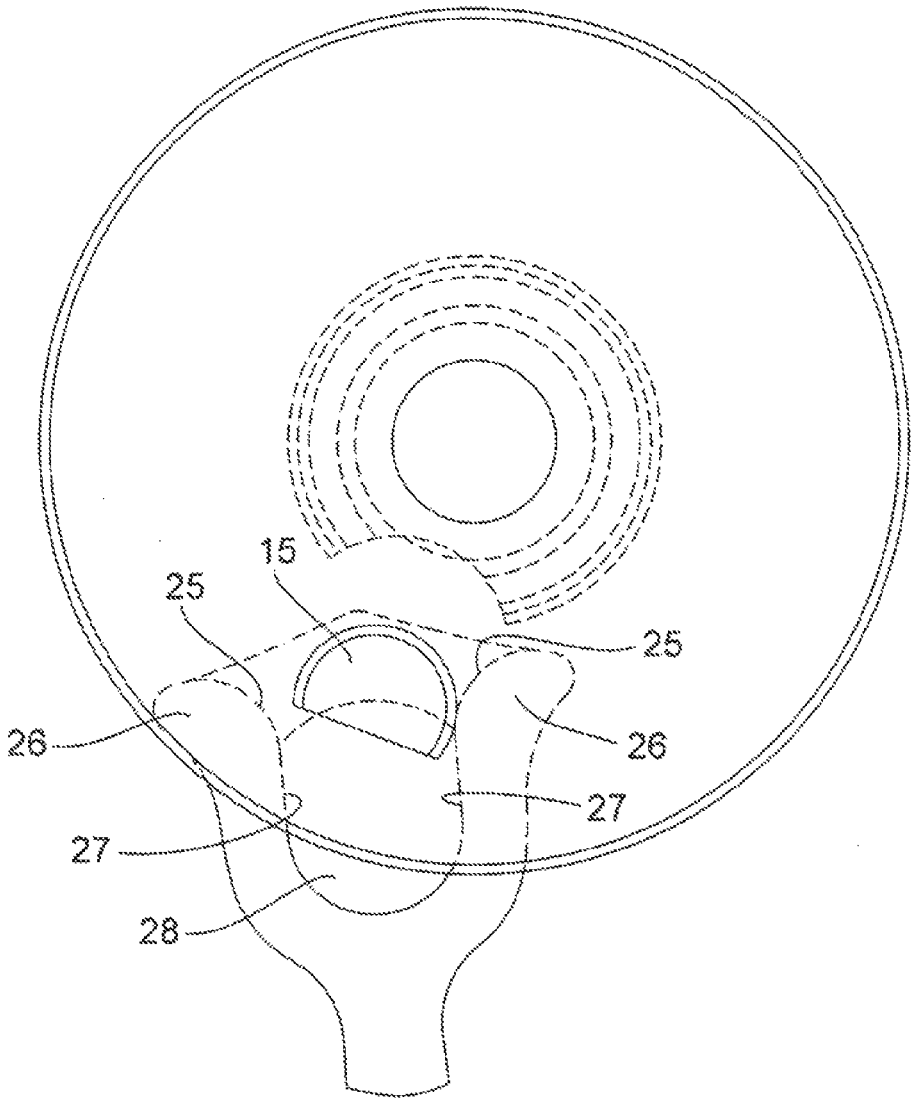
FIG. 15 shows a plan view of a part of an escapement in accordance with a third embodiment of the invention.

It has also been noted by the present inventor that considerable damage can result from impacts between the fork of the anchor of an escapement and the impulse pin, in particular if these elements, or one of them, is/are produced from a fragile material. As shown in FIG. 3, the transition between the inner face of each horn 14*b* and the corresponding inner face of the fork notch 14*a* is formed by an edge 14*c*. In the event of the watch being subjected to an impact, the impulse pin 15 can strike or be struck by one of these edges 14*c*. Depending on the materials used, such striking can damage the area of the edge 14*c* and/or the impulse pin 15, or even break the edge 14*c* and produce chips which will be free to move in the movement and disrupt operation thereof. FIG. 15 shows an embodiment of the invention in which the inner faces 25 of the horns 26 of the anchor are rounded (convex) so as to ensure a soft transition, with no edge, in other words a transition with a large radius of curvature, between these inner faces 25 and the corresponding inner faces 27 of the fork notch 28. Thus in the event of an impact, the contact pressures and thus the risks of damage are reduced. The anchor is typically produced from a fragile material such as glass, diamond, silicon, silicon carbide, crystallised aluminium oxide or another material based on one of these materials and machined by deep reactive ion etching.

Figure 16:
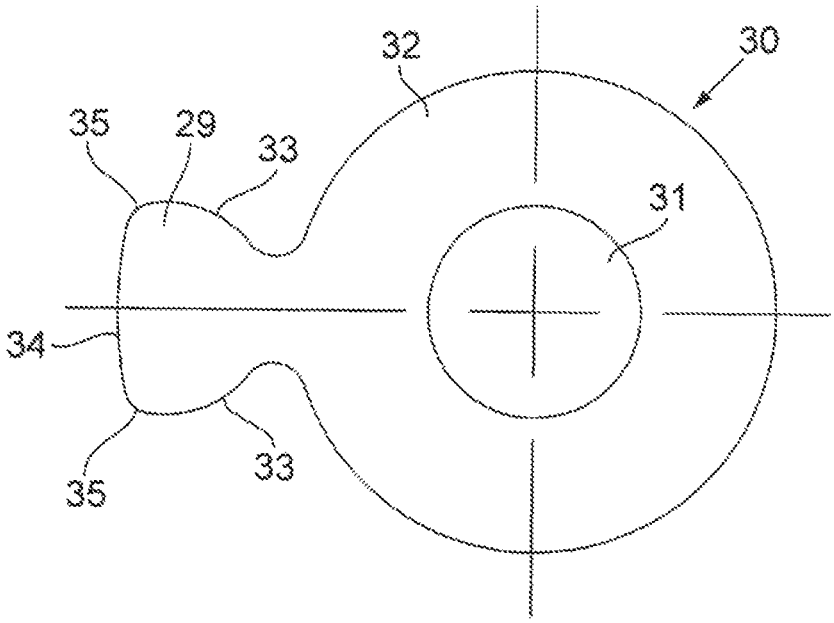
FIG. 16 shows a plan view of a part of an escapement in accordance with a fourth embodiment of the invention.

In a comparable manner it will be noted in FIG. 3 that the impulse pin 15, when in the traditional shape of a half cylinder or cylinder segment, as shown, has edges 15*a* between its cylindrical surface 15*b* and its planar surface 15*c*. When the watch is subjected to an impact, one of these edges 15*a* can strike or be struck by the fork of the anchor. Depending on the materials used, such striking can damage the area of the edge 15*a* and/or the fork of the anchor, or even break the edge 15*a* and produce chips which will be free to move in the movement and disrupt operation thereof. FIG. 16 shows another embodiment of the invention, which can be combined with that of FIG. 15, in which the impulse pin is formed by a protrusion 29 of a single-piece member 30 acting as a transmission member between the anchor and the balance staff. The single-piece member 30 has an opening 31 in order for it to be mounted on the balance staff. The single-piece member 30 is typically produced from a fragile material such as glass, diamond, silicon, silicon carbide, crystallised aluminium oxide or another material based on one of these materials and machined by deep reactive ion etching. The protrusion 29 protrudes radially on the periphery of an annular part 32 of the member 30 having the opening 31. The protrusion 29 has two opposing convex lateral surfaces 33 in the form of segments of a same cylinder. These two surfaces 33 are the active surfaces of the protrusion 29, which come into contact and cooperate with the fork of the anchor during normal operation of the escapement, in the same manner as the cylindrical surface 15*b* of the impulse pin 15. The end of the protrusion 29 is formed by a convex cylindrical surface 34 of a greater radius of curvature than the surfaces 33. This surface 34 corresponds to the planar surface 15*c* of the impulse pin 15 and is inactive in the sense that it is not intended to come into contact with the fork of the anchor during normal operation of the escapement. In the same way as the surface 15*c*, this surface 34 serves to define the safety provisions of the escapement in terms of clearance of horns and clearance of corners. In the present invention the convexity of this surface 34 makes it possible to substantially round off the transition 35 between each of the surfaces 33 and the surface 34 and thus to remove the edges 15*a* in order to reduce the contact pressures and thus the risks of damage in the event of the watch being subjected to impacts. The radius of curvature of the surface 34 is chosen to be sufficiently small so that the transitions 35 are soft, i.e. have a large radius of curvature, and sufficiently large to preserve sufficient safety in terms of clearance of horns and clearance of corners. The single-piece member 30 can be associated with a safety roller of the type designated by the reference 5 in FIG. 3. It can be attached to this safety roller or form a single piece therewith.

The invention claimed is:

1. A timepiece escapement having an escapement wheel (1) and an anchor (2), the anchor (2) comprising an entry pallet (6) and an exit pallet (7) cooperating with teeth (8) on the escapement wheel (1), each of the entry and exit pallets (6, 7) having a back side (9), an impulse beak (10), an impulse face (11) and a lock face (12), the anchor (2) and/or the escapement wheel (1) comprising means (17, 18) for limiting the oscillations of the anchor (2) during normal operation of the escapement to a range of displacement defined by an entry lock position where the entry pallet (6) blocks the escapement wheel (1) and by an exit lock position where the exit pallet (7) blocks the escapement wheel (1), wherein the escapement wheel (1) comprises, at a periphery, protrusions (20, 21, 22) arranged so that:

upon an impact having the effect of causing the anchor (2) to leave the said range of displacement in a first direction (F3), the impulse face (11) and the back side (9) of the entry pallet (6) can come into abutment on two (20, 21) of the protrusions (20, 21, 22) respectively and thus stop the anchor (2), without contact between the impulse beak (10) of the entry pallet (6) and the escapement wheel (1), and/or so that upon an impact having the effect of causing the anchor (2) to leave the said range of displacement in a second direction (F4), the impulse face (11) and the back side (9) of the exit pallet (7) can come into abutment on two (22, 20) of the protrusions (20, 21, 22) respectively and thus stop the anchor (2), without contact between the impulse beak (10) of the exit pallet (7) and the escapement wheel (1).

2. The escapement as claimed in claim 1, wherein said protrusions (20, 21, 22) comprise first protrusions (20) located between the teeth (8) of the escapement wheel (1) and each being able to serve as an abutment for the impulse face (11) of the entry pallet (6) in the event of an impact having the effect of causing the anchor (2) to leave the said range of displacement in the first direction (F3), and to serve as an abutment for the back side (9) of the exit pallet (7) in the event of an impact having the effect of causing the anchor (2) to leave the said range of displacement in the second direction (F4).

3. The escapement as claimed in claim 2, wherein said protrusions (20, 21, 22) comprise second protrusions (21) located on the rear flanks of the teeth (8) of the escapement wheel (1) or between the said teeth (8) and each being able to serve as an abutment for the back side (9) of the entry pallet (6) in the event of an impact having the effect of causing the anchor (2) to leave the said range of displacement in the first direction (F3).

4. The escapement as claimed in claim 1, wherein said protrusions (20, 21, 22) comprise second protrusions (21) located on the rear flanks of the teeth (8) of the escapement wheel (1) or between the said teeth (8) and each being able to serve as an abutment for the back side (9) of the entry pallet (6) in the event of an impact having the effect of causing the anchor (2) to leave the said range of displacement in the first direction (F3).

5. The escapement as claimed in claim 1 wherein said protrusions (20, 21, 22) comprise third protrusions (22) located on the front flanks of the teeth (8) of the escapement wheel (1) or between the said teeth (8) and each being able to serve as an abutment for the impulse face (11) of the exit pallet (7) in the event of an impact having the effect of causing the anchor (2) to leave the said range of displacement in the second direction (F4).

6. The escapement as claimed in claim 1, wherein said protrusions (20, 21, 22) are rounded.

7. The escapement as claimed in claim 1, wherein said means for limiting the oscillations of the anchor (2) comprise a corner defined by the lock face (12) of the entry pallet and/or of the exit pallet (6, 7) and with which a lock beak (19) of the teeth (8) of the escapement wheel (1) can cooperate.

8. The escapement as claimed in claim 7, wherein the corner is defined by a return plane (18) and by a lock plane (17) which are formed on the lock face (12) of the entry pallet and/or of the exit pallet (6, 7), and wherein said protrusions (20, 21, 22) are arranged so that:

after an impact having the effect of causing the anchor (2) to leave the said range of displacement in the first direction (F3) as far as the said stopping of the anchor (2), one (20) of the said two protrusions (20, 21) can push the anchor (2) towards its entry lock position until cooperation between the lock beak (19) of a tooth (8) of the escapement wheel (1) and the return plane (18) of the entry pallet (6) finishes returning the anchor (2) to its entry lock position under the action of the rotation of the escapement wheel (1);

and/or so that:

after an impact having the effect of causing the anchor (2) to leave the said range of displacement in the second direction (F4) as far as the said stopping of the anchor (2), one (22) of the said two protrusions (22, 20) can push the anchor (2) towards its exit lock position until cooperation between the lock beak (19) of a tooth (8) of the escapement wheel (1) and the return plane (18) of the exit pallet (7) finishes returning the anchor (2) to its exit lock position under the action of the rotation of the escapement wheel (1).

9. The escapement as claimed in claim 1, wherein the escapement wheel (1) is produced as a single piece.

10. The escapement as claimed in claim 1, wherein the anchor (2) is produced as a single piece.

11. The escapement as claimed in claim 1, wherein at least one of the anchor (2) and the escapement wheel (1) is produced from a fragile material.

12. The escapement as claimed in claim 11, wherein said fragile material is glass, diamond, silicon, silicon carbide, crystallised aluminium oxide or another material based on one of these materials.

13. The escapement as claimed in claim 1, wherein the anchor comprises a fork having a fork notch (28) and horns (26), and wherein the inner face (25) of each horn (26) is rounded so as to soften the transition between this inner face (25) and the corresponding inner face (27) of the fork notch (28).

14. The escapement as claimed in claim 1, further comprising a member (30) for transmission between the anchor and a balance staff, wherein this member (30) comprises a part (29) acting as an impulse pin (15), wherein said part (29) comprises convex active surfaces (33) and an inactive surface (34) connecting the active surfaces (33) to each other, and wherein the inactive surface (34) is convex with a radius of curvature which is greater than that of the active surfaces (33), so as to soften the transition (35) between the inactive surface (34) and each of the active surfaces (34).

15. The escapement as claimed in claim 14, wherein said member (30) is a single-piece member comprising an opening (31) for its mounting on the balance staff and a protrusion (29) extending radially and constituting the said part (29) acting as an impulse pin (15).

16. The escapement as claimed in claim 1, wherein the escapement is a Swiss lever escapement.

17. A timepiece comprising an escapement as claimed in claim 1.

* * * * *